US009089738B1

(12) United States Patent
Rosploch

(10) Patent No.: US 9,089,738 B1
(45) Date of Patent: Jul. 28, 2015

(54) REHABILITATION DEVICE

(71) Applicant: Jonathon Rosploch, Green Bay, WI (US)

(72) Inventor: Jonathon Rosploch, Green Bay, WI (US)

( * ) Notice: Subject to any disclaimer, the term of this patent is extended or adjusted under 35 U.S.C. 154(b) by 261 days.

(21) Appl. No.: 13/650,789

(22) Filed: Oct. 12, 2012

Related U.S. Application Data

(60) Provisional application No. 61/546,630, filed on Oct. 13, 2011.

(51) Int. Cl.
*A63B 21/00* (2006.01)
*A63B 21/075* (2006.01)

(52) U.S. Cl.
CPC ..... *A63B 21/075* (2013.01)

(58) Field of Classification Search
USPC ..... 482/104, 105, 106, 107, 108, 49, 109
See application file for complete search history.

(56) References Cited

U.S. PATENT DOCUMENTS

| | | | | |
|---|---|---|---|---|
| 3,351,346 | A | 11/1967 | Strahan | |
| 3,414,260 | A | 12/1968 | Gust | |
| 3,874,660 | A | 4/1975 | Brethen | |
| 4,377,282 | A | 3/1983 | Hayes | |
| 4,484,740 | A | 11/1984 | Green | |
| 5,281,192 | A | 1/1994 | Nelson | |
| 5,312,308 | A | 5/1994 | Hamilton et al. | |
| 5,435,800 | A | 7/1995 | Nelson | |
| 5,449,333 | A | 9/1995 | Carter | |
| 5,718,654 | A | 2/1998 | Kennedy | |
| 5,769,757 | A | 6/1998 | Fulks | |
| 6,196,033 | B1 * | 3/2001 | Dowdle | 70/16 |
| 6,846,244 | B1 * | 1/2005 | Davis | 473/208 |
| 7,557,286 | B2 | 7/2009 | Capotosto | |
| 8,172,727 | B2 * | 5/2012 | Berman et al. | 482/44 |
| 8,684,889 | B1 * | 4/2014 | Berrisford | 482/49 |
| 2006/0281609 | A1 | 12/2006 | Shah | |
| 2008/0026920 | A1 | 1/2008 | Berenshteyn | |

OTHER PUBLICATIONS

MEDCO Catalog, p. 300, Rehab & Exercise, Forearm Exercises & Weight Bars, "Forearm Workout"; "Mojo"; "Premium Forearm Exerciser"; "Forearm Exerciser", no date.
On-line Order Form Monster Barbell Co., Forearm Strength Training, E-Flex Forearm Bars; Monster Barbell & Fitness Co. LLC 2003-2007.
On-line Order Form APT Pro Gear—Forearm Strength Pro Bar Series Olympic or Standard, 2011.
On-line Order Form Patterson Medical, Rehab Supplies, Forearm Workout, Copyright 2011 Patterson Medical Products, Inc.
On-line Order Form Watson Gym Equipment Thors Hammer; no date.

* cited by examiner

*Primary Examiner* — Jerome W Donnelly
(74) *Attorney, Agent, or Firm* — Boyle Fredrickson, S.C.

(57) ABSTRACT

A rehabilitation device is provided by the present disclosure includes a handle to be grasped by an individual and a strap mechanism attached to one end of the handle, the strap mechanism adapted to releasably secure a weight to the handle. The strap mechanism includes an elongate portion and a locking portion adapted to releasably engage the elongate portion to enable the weight to be secured to the handle for use in rehabilitation exercises for the hand, wrist and/or forearm.

20 Claims, 5 Drawing Sheets

REHABILITATION DEVICE

CROSS-REFERENCE TO RELATED APPLICATION

This application claims priority from U.S. Provisional Application Ser. No. 61/546,630, filed on Oct. 13, 2011, the entirety of which is hereby expressly incorporated by reference herein.

FIELD OF THE INVENTION

The present invention relates generally to a device for use in rehabbing an injury, and more specifically to a device for use in rehabilitation exercises designed to assist in the recovery of the hand, wrist and forearm.

BACKGROUND OF THE INVENTION

There are many types of exercise devices that have been developed for developing the extremities of the human body, including the hands, wrists and lower arms or forearms. These devices provide various abilities to work the muscles and joints of these particular body parts.

However, in rehabilitating these parts of the body, care must be taken in order to avoid reinjuring the individual due to the nature of these body parts. Therefore, it is desirable to develop a rehabilitation device for use with the hand, wrist and forearm that provides the ability to tailor the stress applied by the device to the individual in accordance with the significance of the injury sustained by the individual, while also being able to focus the work done using the device on the desired portions of the body.

SUMMARY OF THE INVENTION

Briefly described, one aspect of the present disclosure provides a rehabilitation device for use in strengthening the hand, wrist and/or forearm of an individual. The device includes a handle that is ergonomically shaped to enable the handle to be grasped easily and comfortably by an individual. The handle may also include a grip to further comfort the handle when grasped by an individual.

To provide the resistance to the movement of the hand, wrist and forearm, the handle includes a strap mechanism on the end of the handle generally opposite the portion of the handle that is grasped by the individual. The strap mechanism enables an individual to secure a weight of a desired size to the handle to provide the selected amount of resistance to the individual when utilizing the device. The strap mechanism enables a number of different types of weights to be secured to the handle, as the strap mechanism includes a locking portion and an elongate portion that is releasably engageable with the locking portion. Thus, as long as the elongate portion can be engaged with the locking portion around the selected weight, the weight can be used with the device.

Numerous other aspects, features, and advantages of the present invention will be made apparent from the following detailed description together with the drawings figures.

BRIEF DESCRIPTION OF THE DRAWINGS

The drawings illustrate the best mode currently contemplated of practicing the present disclosure.

In the drawings.

DETAILED DESCRIPTION OF THE INVENTION

Figure 1:
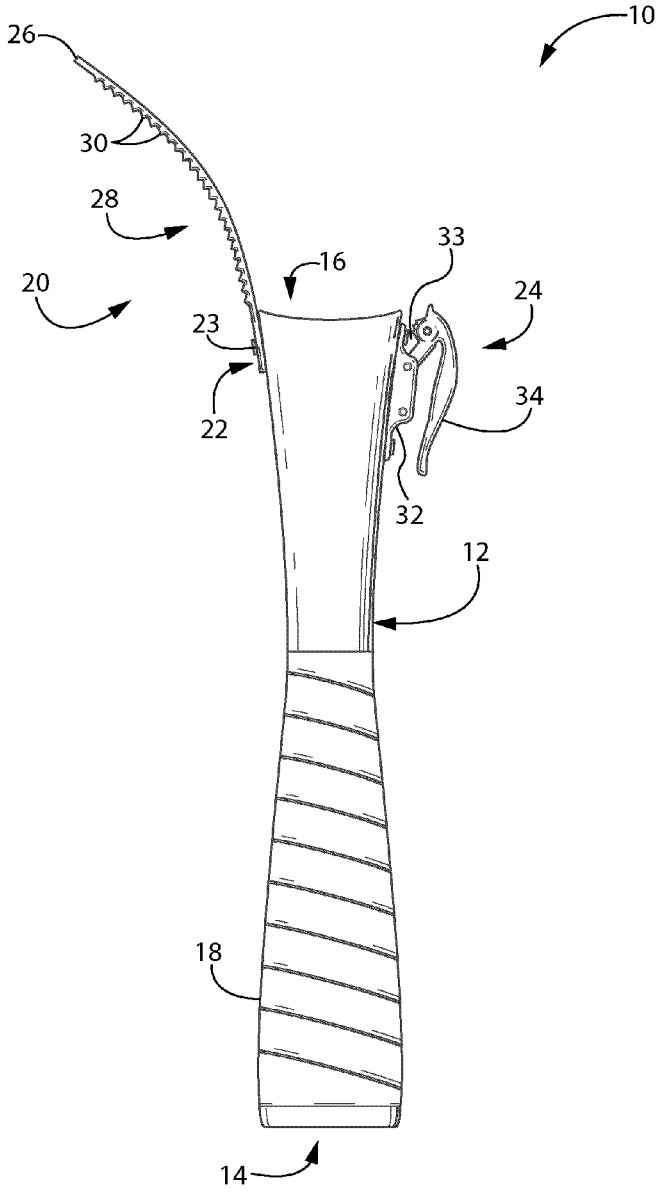
FIG. 1 is a top plan view of a one embodiment of a rehabilitation device constructed according to the present disclosure.

Referring now in detail to the drawing figures, wherein like reference numerals represent like parts throughout the several views, one embodiment of a device constructed according to the present disclosure is illustrated generally at 10 in FIG. 1. The device 10 in the illustrated embodiment is formed with a handle 12 having a first end 14 and a second end 16. The handle 12 can be formed of any suitable material, such as a metal, plastic or wood capable of enabling the device 10 to perform in its intended manner. Additionally, the handle 12 can have any desired axial and/or cross-sectional shape suitable for the intended purpose of the device 10. The handle 12 can also include any suitable structure (not shown), such as a strap, that assists the user in retaining a grip on the handle 12. In the illustrated embodiment, the handle 12 has an ergonomic shape, which can be shaped similar to a handle for a conventional hammer.

At the first end 14, the handle 12 includes a grip 18. The grip 18 conforms to the shape of the first end 14 of the handle 12. The grip 18 is formed of any conventional grip material, such as leather or foamed materials, among others, in order to provide additional comfort to the hand of the individual grasping the grip 18 in addition to that afforded by the shape of the handle 12. Further, the grip 18 can be fashioned with any suitable structures or shape, including, but not limited to, grooves (not shown) for the positioning of fingers therein to effect proper positioning of the fingers on the grip 18 and the handle 12.

Referring now to FIGS. 2-5, generally opposite the grip 18, the handle 12 includes a strap mechanism 20. The strap mechanism 20 includes an elongate portion 22 secured to the handle 12 and a locking portion 24 also secured to the handle 12, but spaced from the elongate portion 22. In the illustrated embodiment the elongate portion 22 is attached to the handle generally opposite the locking portion 24, though other configurations are also contemplated as being within the scope of the disclosure.

In the illustrated embodiment, the elongate portion 22 is formed of a length of a suitable durable material, such as leather, metal or plastic, among others. Further, in the illustrated embodiment, the elongate portion 22, in addition to being movable with respect to the handle 12, is capable of bending with one end of the elongate portion 22 affixed to the handle 12 in a suitable manner using any suitable securing or fixation member, such as a pin or a screw. In the illustrated embodiment, the elongate portion 22 is secured to the handle 12 using a screw 23 as the securing member.

The end 26 of the elongate portion 22 spaced from the handle 12 can be moved, bent or flexed to bring the end 26 into engagement with the locking portion 24 to secure the elongate portion 22 to the locking portion 24. To facilitate the engagement of the elongate portion 22 with the locking portion 24, the elongate portion 22 has a number of locking members 28 disposed along the length of the elongate portion 22. These locking members 28 are capable of being engaged by the locking portion 24 to secure the elongate portion 22 to the locking portion 24. In the illustrated embodiment, the locking members 28 take the form of teeth or ridges 30 extending outwardly from the elongate portion 22. In addition, the locking member 28 can be formed integrally with the elongate portion 22 or can be attached thereto.

The locking portion 24 can be any suitable mechanism capable of securely and releasably engaging the end 28 of the elongate portion 22, but in the illustrated embodiment is formed similarly to various ski binding mechanisms, such as that shown in U.S. Pat. No. 5,887,318, incorporated by reference herein in its entirety.

In the illustrated embodiment, the locking portion 24 includes a generally U-shaped base 32 affixed to the handle 12, such as by screws 23, and defining a channel 33 therein. A latch 34 is pivotally secured to the base 32 over the channel 33 in an over-center cam manner that enables the latch 34 to be self closing. Additionally the latch 34 can be biased into a locked position within the channel 33, such as by a spring (not shown) and openable only by application of sufficient force to overcome the biasing force on the latch 34 in order to pivot the latch 34 out of the channel 33, thereby disengaging projections 36 on the latch 34 from the locking members 28. The latch 34 includes a number of projections 36 that can selectively be aligned with and engage the ridges 30 on the elongate portion 22 to secure the elongate portion 22 to the locking portion 24. Alternatively, the latch 34 can frictionally engage the end 26 by compressing the end 26 between the latch 34 and the base 32 without the need for locking members 28 or projections 36.

Figure 2:
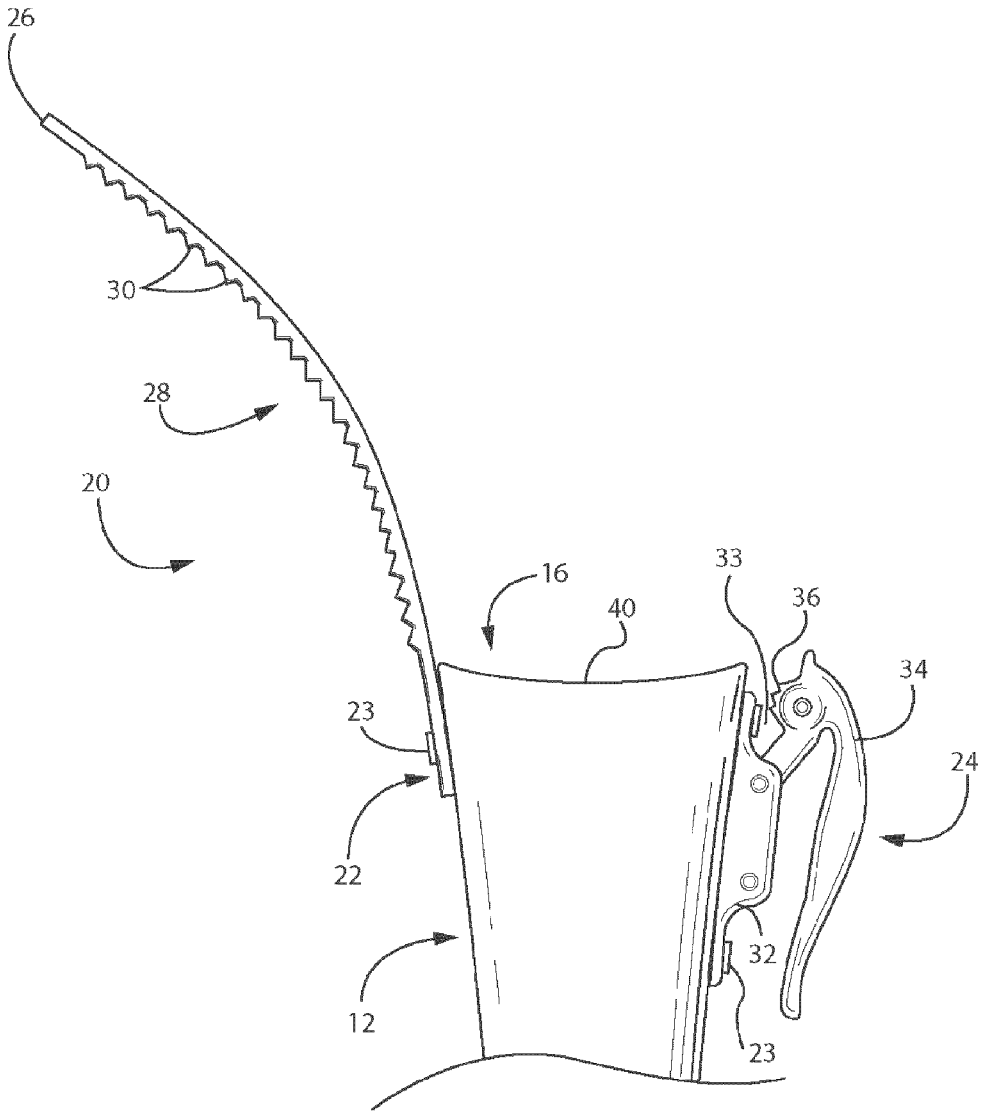
FIG. 2 is a partially broken away top plan view of a strap mechanism on the device of FIG. 1 in a disengaged position.
Figure 3:
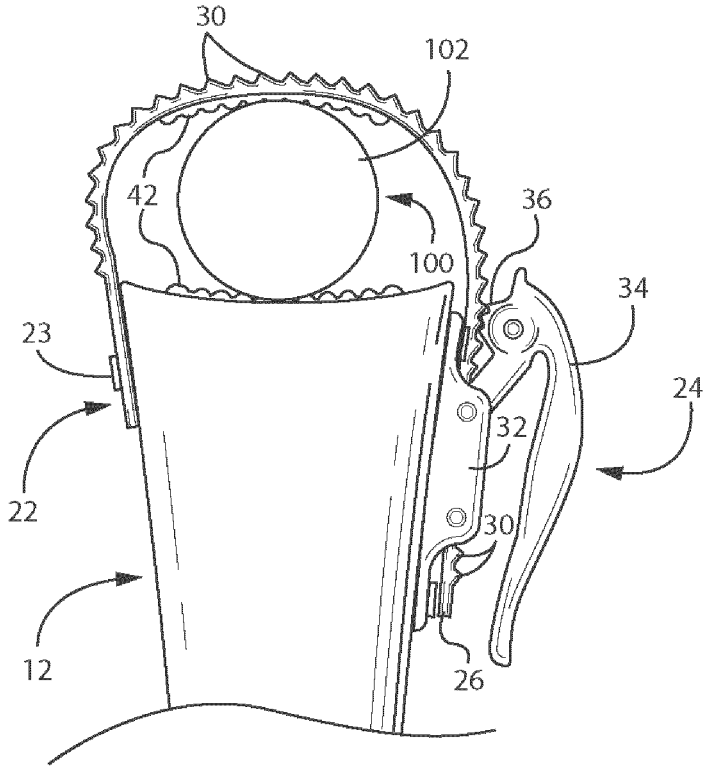
FIG. 3 is a partially broken away top plan view of the strap mechanism of FIG. 2 in an engaged configuration around a weight.

In operation, as shown in FIGS. 1-3, with the elongate portion 22 disengaged from the locking portion 24, a weight 100, such as a dumbbell is positioned on the handle 12 between the elongate portion 22 and the locking portion 24. The end 26 of the elongate portion 22 is then bent over the weight and engaged with the locking portion 24 by sliding the end 26 and the locking members 28 into the channel 33. In this position, the projections on the latch 34 are engaged with the locking members 28 on the elongate portion 22 to lock the elongate portion 22 over the weight, thereby securely holding it on the handle 12. In this configuration best shown in FIG. 5, the device 10 can be used in a number of different exercises to strengthen the hands, wrists and/or forearms of the individual utilizing the device 10.

Figure 4:
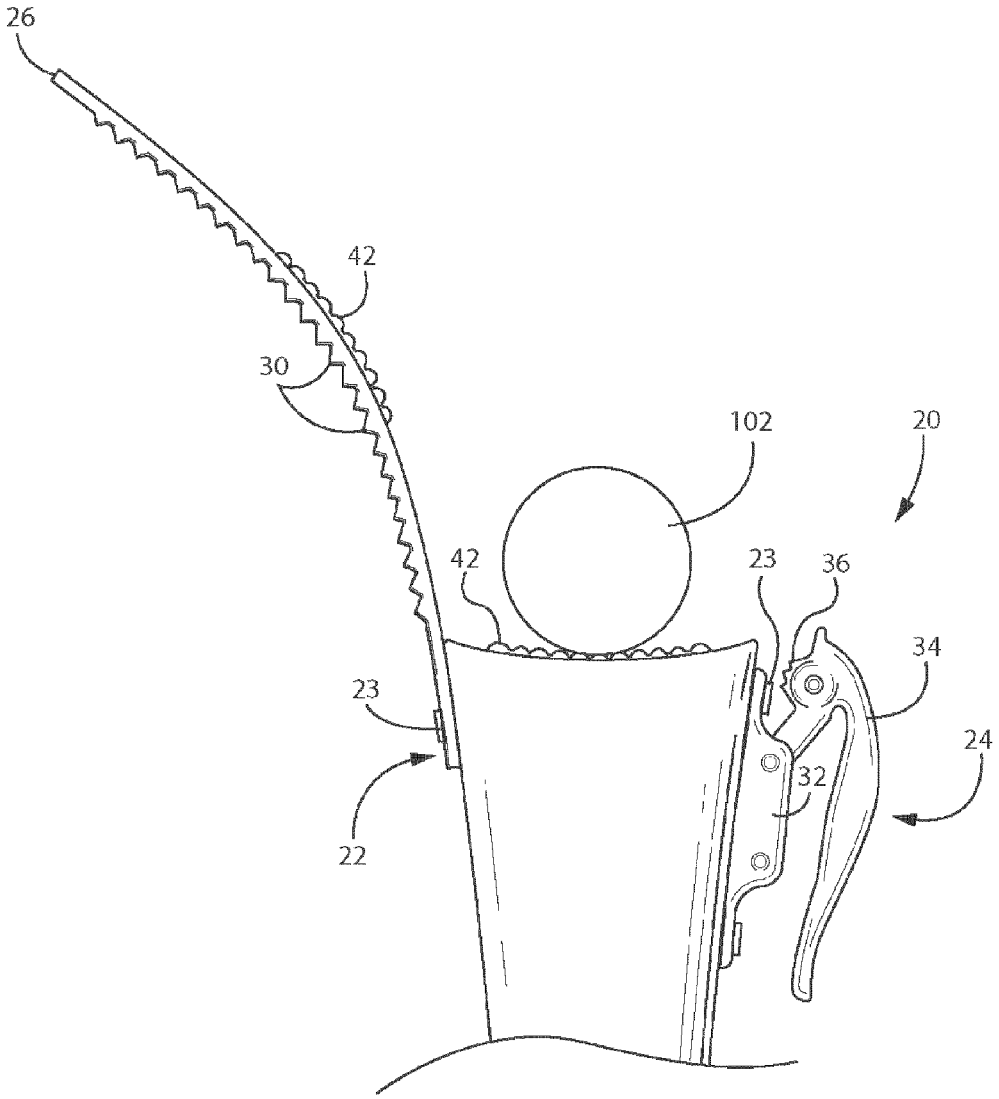
FIG. 4 is a partially broken away top plan view of the strap mechanism of FIG. 3 in a disengaged position around the weight.
Figure 5:
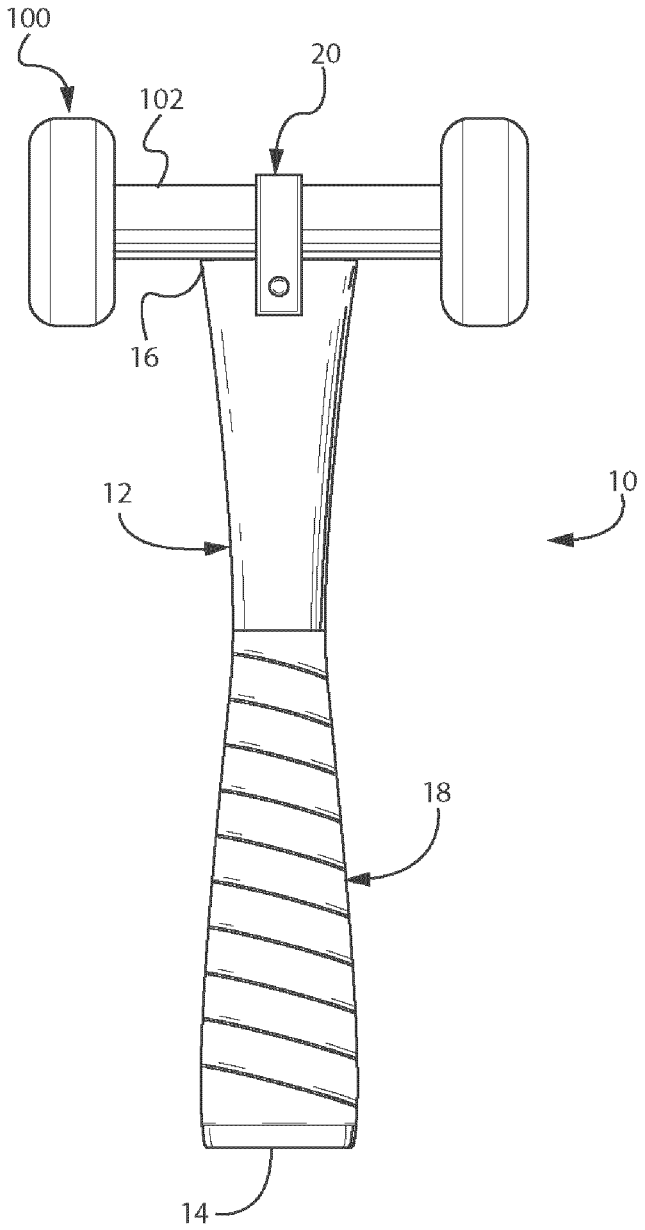
FIG. 5 is a side plan view of the device of FIG. 1 in an engaged position around a weight.

When it is desired to change the weight, as shown in FIG. 4 the latch 34 of the locking portion 24 is pivoted out of the channel 33 on the base 32 to enable the end 26 of the elongate portion 22 and the locking members 28 to be slid outwardly from the base 32.

In the illustrated embodiment, to assist the strap mechanism 20 in holding the weight 100 in the desired configuration on the handle 12, the end 16 of the handle 12 can be formed with an optional recess 40 within which the weight can partially be seated. In the situation where the weight is a dumbbell, the central cylindrical portion 102 of the dumbbell 100 can be positioned in the recess 40 with the opposed end extending outwardly from the sides of the handle 12. Also, where the weight is a circular weight (not shown) with a central aperture therein (not shown), the elongate portion 22 can be inserted through the aperture before engagement with the locking portion 24 to hold the weight on the handle 12.

Additionally, the elongate portion 22 and/or the handle 12 can include structures 42 thereon which can assist in engaging and holding the weight, regardless of the form of the weight, on the handle 12.

In still another embodiment, the handle 12 can be formed to be telescoping, such that the end 16 including the strap mechanism 20 and the weight 100 can be moved relative to the end 14 including the grip 18. The handle 12 of this embodiment can also include a suitable locking device (not shown) that is used to maintain the handle 12 in the desired telescoped, or extended position, such that the weight 100 can be spaced from the end 14 to increase or decrease the force exerted by the device 10 when in use by an individual.

Various other embodiments of the present invention are contemplated as being within the scope of the filed claims particularly pointing out and distinctly claiming the subject matter regarded as the invention.

The invention claimed is:

1. A rehabilitation device comprising:

a) a handle to be grasped by an individual, the handle including a first wide end, and second wide end opposite the first wide end and a narrow middle disposed between the first and second wide ends; and b) a strap mechanism attached to only the first end of the handle, the strap mechanism adapted to releasably secure a weight to the handle.

2. The device of claim 1 wherein the strap mechanism includes an elongate portion and a locking portion adapted to releasably engage the elongate portion.

3. The device of claim 2 wherein the elongate portion includes a number of locking members thereon.

4. The device of claim 3 wherein the locking portion releasably engages the locking members on the elongate portion.

5. The device of claim 4 wherein the locking portion includes a number of projections engageable with the locking members on the elongate portion.

6. The device of claim 2 wherein the elongate portion and the locking portion are secured to opposite sides of the handle.

7. The device of claim 6 further comprising a recess formed in the first end of the handle between the elongate portion and the locking portion.

8. The device of claim 2 wherein the elongate member is a flexible elongate member.

9. The device of claim 1 wherein the handle includes a grip attached to the handle opposite the strap mechanism and extending between the second end and the middle of the handle.

10. The device of claim 1 wherein the handle is a telescoping handle.

11. A method of exercising the muscles and joints of the hand, wrist and/or forearm, the method comprising the steps of:

a) providing a device including a handle to be grasped by an individual, the handle including a first wide end, and second wide end opposite the first wide end and a narrow middle disposed between the first and second wide ends and a strap mechanism attached to only the first end of the handle, the strap mechanism adapted to releasably secure a weight to the handle;

b) attaching a weight to the handle with the strap mechanism; and c) moving the handle with the weight attached.

12. The method of claim 11 wherein the strap mechanism includes an elongate portion and a locking portion adapted to releasably engage the elongate portion, and wherein the step of attaching a weight to the handle comprises the steps of:

a) placing the weight against the handle adjacent the elongate portion;

b) moving the elongate portion over the weight; and c) engaging the elongate portion with the locking portion.

13. The device of claim 1 further comprising an engaging structure disposed on the device and adapted to engage the weight when secured to the handle by the strap mechanism.

14. The device of claim 13 wherein the engaging structure is disposed on the elongate portion opposite the number of locking members.

15. The device of claim 13 wherein the engaging structure is disposed on at least one of the handle and the strap mechanism.

16. The device of claim 14 wherein the engaging structure is disposed on both of the handle and the strap mechanism.

17. The device of claim 13 wherein the engaging structure is disposed within a recess formed in the first end of the handle adjacent the strap mechanism.

18. The device of claim 1 further comprising a weight disposed between the first end of the handle and the strap mechanism.

19. A rehabilitation device comprising:

a) a handle to be grasped by an individual, the handle including a first end, and second end opposite the first end;

b) a strap mechanism attached to one end of the handle; and c) a weight disposed between the first end of the handle and the strap mechanism.

20. The device of claim 19 wherein the weight has a narrow section disposed between the first end and the strap mechanism and a pair of wide ends disposed at each end of the narrow section.

* * * * *